US009877132B2

(12) United States Patent
Engdegard et al.

(10) Patent No.: US 9,877,132 B2
(45) **Date of Patent: *Jan. 23, 2018**

(54) AUDIO SIGNAL OF AN FM STEREO RADIO RECEIVER BY USING PARAMETRIC STEREO

(71) Applicant: DOLBY INTERNATIONAL AB, Amsterdam Zuidoost (NL)

(72) Inventors: Jonas Engdegard, Stockholm (SE); Heiko Purnhagen, Sundbyberg (SE); Karl Jonas Roeden, Solna (SE)

(73) Assignee: Dolby International AB, Amsterdam (NL)

( * ) Notice: Subject to any disclaimer, the term of this patent is extended or adjusted under 35 U.S.C. 154(b) by 494 days.

This patent is subject to a terminal disclaimer.

(21) Appl. No.: 14/555,568

(22) Filed: Nov. 26, 2014

(65) Prior Publication Data

US 2015/0086022 A1 Mar. 26, 2015

Related U.S. Application Data

(63) Continuation of application No. 13/394,799, filed as application No. PCT/EP2010/005481 on Sep. 7, 2010, now Pat. No. 8,929,558.

(Continued)

(51) Int. Cl.
*H04S 3/00* (2006.01)
*H04S 1/00* (2006.01)

(Continued)

(52) U.S. Cl.
CPC ..... *H04S 3/00* (2013.01); *G10L 19/008* (2013.01); *H04H 40/45* (2013.01); *H04S 1/007* (2013.01);

(Continued)

(58) Field of Classification Search
CPC ... H04S 1/00; H04S 1/007; H04S 3/00; H04S 5/00; H04S 2420/03; H04H 40/45; H04H 40/72; H04H 40/81; G10L 19/008

(Continued)

(56) References Cited

U.S. PATENT DOCUMENTS 3,823,268 A 7/1974 Modafferi
4,390,749 A 6/1983 Pearson (Continued)

FOREIGN PATENT DOCUMENTS

CN 1748247 A 3/2006
CN 1758337 A 4/2006

(Continued)

OTHER PUBLICATIONS

Schuijers, E. et al. "Low Complexity Parametric Stereo Coding" AES 116$^{th}$ Convention; May 8-11, 2004, Berlin, Germany. 11 pages.

(Continued)

*Primary Examiner* — Davetta W Goins
*Assistant Examiner* — Daniel Sellers
(74) *Attorney, Agent, or Firm* — Brian Cash; Steinfl & Bruno, LLP

(57) ABSTRACT

The invention relates to a method for improving a stereo audio signal of an FM stereo radio receiver. The method comprises determining one or more parametric stereo parameters based on the stereo audio signal in a frequency-variant or frequency-invariant manner. Preferably, these PS parameters are time- and frequency-variant. Moreover, the method comprises generating the improved stereo signal based on a first audio signal and the one or more parametric stereo parameters. The first audio signal is obtained from the stereo audio signal, e.g. by a downmix operation.

18 Claims, 4 Drawing Sheets

Related U.S. Application Data

(60) Provisional application No. 61/241,113, filed on Sep. 10, 2009.

(51) Int. Cl.

| | |
|---|---|
| ***H04S 5/00*** | (2006.01) |
| ***G10L 19/008*** | (2013.01) |
| ***H04H 40/45*** | (2008.01) |
| ***H04H 40/72*** | (2008.01) |
| ***H04H 40/81*** | (2008.01) |

(52) U.S. Cl.
CPC ..... *H04H 40/72* (2013.01); *H04H 40/81* (2013.01); *H04S 1/00* (2013.01); *H04S 5/00* (2013.01); *H04S 2420/03* (2013.01)

(58) Field of Classification Search
USPC ..... 381/103
See application file for complete search history.

(56) References Cited

U.S. PATENT DOCUMENTS

| | | | |
|---|---|---|---|
| 4,426,727 | A | 1/1984 | Hamada |
| 4,485,483 | A | 11/1984 | Torick |
| 4,496,979 | A | 1/1985 | Yu |
| 4,602,380 | A | 7/1986 | Stebbings |
| 4,833,715 | A | 5/1989 | Sakai |
| 4,910,799 | A | 3/1990 | Takayama |
| 5,249,233 | A | 9/1993 | Kennedy |
| 6,178,316 | B1 | 1/2001 | Dinnan |
| 6,535,608 | B1 | 3/2003 | Taira |
| 6,539,357 | B1 | 3/2003 | Sinha |
| 6,725,027 | B1 | 4/2004 | Tsuji |
| 7,181,019 | B2 | 2/2007 | Breebaart |
| 7,382,886 | B2 | 6/2008 | Henn |
| 7,391,870 | B2 | 6/2008 | Herre |
| 7,751,572 | B2 | 7/2010 | Villemoes |
| 8,014,534 | B2 | 9/2011 | Henn |
| 8,059,826 | B2 | 11/2011 | Henn |
| 8,073,144 | B2 | 12/2011 | Henn |
| 8,081,763 | B2 | 12/2011 | Henn |
| 2001/0044289 | A1 | 11/2001 | Tsuji |
| 2003/0022650 | A1 | 1/2003 | Tsuji |
| 2003/0087618 | A1 | 5/2003 | Li |
| 2005/0180579 | A1 | 8/2005 | Baumgarte |
| 2005/0182996 | A1 | 8/2005 | Bruhn |
| 2006/0023891 | A1 | 2/2006 | Henn |
| 2006/0083385 | A1 | 4/2006 | Allamanche |
| 2006/0195314 | A1 | 8/2006 | Taleb |
| 2006/0229751 | A1 | 10/2006 | Barnhill |
| 2009/0164223 | A1 | 6/2009 | Fejzo |
| 2010/0010807 | A1 | 1/2010 | Oh et al. |
| 2010/0046761 | A1 | 2/2010 | Henn |
| 2010/0046762 | A1 | 2/2010 | Henn |
| 2012/0002818 | A1 | 1/2012 | Purnhagen |

FOREIGN PATENT DOCUMENTS

| | | | |
|---|---|---|---|
| CN | 1324813 | C | 7/2007 |
| CN | 101390443 | A | 3/2009 |
| CN | 101518103 | | 8/2013 |
| DE | 3048263 | | 7/1982 |
| DE | 244666 | | 4/1987 |
| DE | 10202635 | | 8/2003 |
| EP | 0618693 | | 10/1994 |
| EP | 0940913 | | 9/1999 |
| EP | 1069693 | | 1/2001 |
| EP | 1206043 | | 5/2002 |
| JP | 1984/052937 | | 3/1984 |
| JP | 61242133 | | 10/1986 |
| JP | S63194437 | | 8/1988 |
| JP | 1989/1072636 | | 3/1989 |
| JP | 3259624 | | 11/1991 |
| JP | H06291692 | | 10/1994 |
| JP | H0846585 | | 2/1996 |
| JP | 2003/283349 | | 10/2003 |
| JP | 2006/303799 | | 11/2006 |
| JP | 2007/060469 | | 3/2007 |
| JP | 3963747 | | 8/2007 |
| JP | 2008/519301 | | 6/2008 |
| JP | 2008/158496 | | 7/2008 |
| JP | 2009/010841 | | 1/2009 |
| SU | 1601758 | | 10/1990 |
| TW | 2007/07411 | A | 2/2007 |
| WO | 1984/003807 | | 9/1984 |
| WO | 1986/004201 | | 7/1986 |
| WO | 9108624 | | 6/1991 |
| WO | 2003/007656 | | 1/2003 |
| WO | 03063547 | | 7/2003 |
| WO | 2003/090208 | | 10/2003 |
| WO | 2004/008805 | | 1/2004 |
| WO | 2004/008806 | | 1/2004 |
| WO | 2004/072956 | | 8/2004 |
| WO | 2004/077690 | | 9/2004 |
| WO | 2004/086817 | | 10/2004 |
| WO | 2006/048226 | | 5/2006 |
| WO | 2007/110102 | | 10/2007 |
| WO | 2008/032255 | | 3/2008 |
| WO | 2009/005307 | | 1/2009 |
| WO | 2013/017435 | | 2/2013 |

OTHER PUBLICATIONS

ETSI, "ETSI TS 126 401 V6.1.0 (Dec. 2004)", Dec. 2004, ETSI, Version 6.1.0 release 6, pp. 1-13.

1st Office Action issued for Chinese Application No. 201080040083.7 filed in the name of Dolby International AB. dated Jan. 27, 2014.

Office Action issued for Taiwan application No. 099127298 filed Aug. 16, 2010; date of completion of search report: Jul. 26, 2013 (English translation and original).

English translation of Office Action issued for Japan Application No. 2012-528263 filed Nov. 12, 2012 in the name of Christian Kellermann; dated Apr. 16, 2013.

Herre, J., et al., "MPEG Surround—The ISO/MPEG Standard for Efficient and Compatible Multi-Channel Audio Coding", Audio Engineering Convention Paper, 122nd Convention, May 5-8, 2007, Total: 23 pages.

Zhang, et al., "Parametric Stereo Implementation in DRM System" 2008 4th International Conference on Wireless Communications, Networking and Mobile Computing, Conference date: Oct. 12-14, 2008.

Cuevas-Martinez, Juan Carlos, "Scalable Parametric Audio Coder for Internet Audio Streaming" AES Convention, May 2005.

Meltzer, Stefan, "Audio Source Coding in Digital Broadcasting Systems" 5th Workshop Digital Broadcasting, Proc., Erlanden, DE, Sep. 23-24, 2004.

Roeden, J., et al., "HDC Surround, 5.1 Surround Over HD Radio" NAB 2005, 59th Broadcast Engineering Conf., Las Vegas, US, Apr. 16-21, 2005, Abstract Only.

Herre, J., et al., "MP3 Surround: Efficient and Compatible Coding of Multi-Channel Audio" 116th Convention of AES Audio Engineering Society, May 8-11, 2004.

Cuevas-Martinez, J. C., et al., "A Community Hierarchic Based Approach for Scalable Parametric Audio Multicasting Over the Internet" AES Convention, May 2006, paper No. 6708.

Bang, Kyoung Ho, et al., "A Dual Audio Transcoding Algorithm for Digital Multimedia Broadcasting Services" AES Convention, May 2006.

Torick, Emil, "Improving the Signal-to-Noise Ratio and Coverage of FM Stereophonic Broadcasts" AES Convention, Oct. 1984.

Torick, E., et al., "The FMX Stereo Broadcast System" AES Convention, Oct. 1985.

Torick, E., et al., "Improvements in FMX Technology" AES Convention, Nov. 1988, paper No. 2705.

Lugowski, A.M., "FMX-Stereo. A Proposal to Improve the VHF-FM Stereophonic Broadcasting System" published 1987, vol. 60 No. 1, pp. 23-27, Abstract Only.

(56) References Cited

OTHER PUBLICATIONS

Ishikawa, et al., "FMX Decoder IC Development" IEEE transactions on Consumer Electronics, vol. CE-33, No. 3, pp. 312-318, published in Aug. 1987, Abstract Only.
Rucktenwald, et al., "FMX Mobile Reception" IEEE Transactions on Consumer Electronics 1988.
Shorter, G., "Wireless World Dolby Noise Reducer. An Introduction to the Dolby Noise Reduction System" Wireless World, vol. 81, No. 1473, pp. 200-205, published May 1975.
Dolby, "Optimum Use of Noise Reduction in FM Broadcasting" Journal of the Audio Engineering Society, vol. 21, No. 5, pp. 357-362, published in Jun. 1973.
Gibson, J.J., et al., "Compatible FM Broadcasting of Panoramic Sound" IEEE Transactions on Broadcast and Television Receivers, vol. BTR-19, No. 4, pp. 286-293, published on Nov. 1973.
Gleiss, N., et al., "Sound Quality of Programmes Transmitted Using the Dolby B System" Tele, vol. 84, No. 2, pp. 29-36, publication date: 1978. Abstract Only.
Stetter, Elmar, "Use of the Dolby B System in FM Radio Broadcasting" published in 1978. Abstract Only.
Robinson, D.P., "Dolby B-Type Noise Reduction for FM Broadcasts" Journal of the Audio Engineering Society, published in Jan. 1, 1973.
Robinson, D.P., "Dolby B-type Processing for FM Broadcasting" published in 1978, pp. 281-285. Abstract Only.
Tsujishita, M., et al., "Digital Signal Processing technology for Car Radios" Mitsubishi Electric Advance, vol. 94 published in Japan on Jun. 2001. Abstract Only.
Elektor "Stereo Noise Suppressor" vol. 10, No. 7-8, published on Jul.-Aug 1984. Abstract Only.
Gravereaux, D., et al., "Re-Entrant Compression and Adaptive Expansion for Optimized Noise Reduction" published in Dec. 1985 by Audio Engineering Society.
Ishida, M., et al., "A Car Use FM Broadcasting Receiver Using Digital Signal Processing Techniques" published in 2003 in USA.
Kantor, L.Y., et al., "A Method of Lowering the Noiseproofness Threshold of Broadband Frequency Modulation and Phase Modulation Receivers" Army Foreign Science and Technology Center Charlottesville, VA. Abstract Only.
Cabot, R.C., "A Dynamic Noise Reducer for Sum-Difference Multiplex Systems" publication date: Mar. 1977 in USA, Journal of the Audio Engineering Society, vol. 25, No. 3, pp. 95-98.
"Noise Filter for Stereo FM" published on Feb. 1978 in Spain. Abstract Only.
Taura, K., et al., "A New Approach to VHF/FM Broadcast Receiver Using Digital Signal Processing Techniques" IEEE Transactions on Consumer Electronics vol. 46, No. 3, pp. 751-757, conference in Jun. 13-15, 2000.
Porges, L., et al., "A Compatible Compandor System for FM Radio and its Technical Application" published in 1983. Abstract Only.
Chow, W.F., "Impulse Noise Reduction Circuit for Communication Receivers" published on May 1960, Institute of Radio Engineers Transactions on Vehicular Communications, vol. VC-9, No. 1, pp. 1-9, Abstract Only.
Slechta, John, "Measure vhf-FM Receiver Sensitivity in any of Three Ways" published on Dec. 1, 1973 Trade Journal. Abstract Only.
Kizer, G.M., "FM Quieting Curves and Related Topics" Electronics Engineering Group Aug. 1977. Abstract Only.
Armstrong, E.H., "Noise Reduction in Radio Signalling by Frequency Modulation" published on May 1936, IRE Proceedings, vol. 24, pp. 689-740, published in USA. Abstract Only.
Nohara, A., et al., "A Noise Suppression System for FM Radio Receiver" IEEE Transactions on Consumer Electronics, 1993, p. 533-539.
Breems, Lucien, et al., "A 56 mW Continuous-Time Quadrature Cascaded ΣΔModulator With 77 dB DR in a Near Zero-IF 20 MHz Band" 2007 IEEE International Solid-State Circuits Conference, p. 2696-2705.
Armstrong, Edwin H., "Method of Reducing Disturbances in Radio Signaling by a System of Frequency Modulation" Proceedings of the IEEE, published on Dec. 1, 1984.
Seeley, S.W., "Frequency Modulation" published in 1941 Journal Article. Abstract Only.
Goldman, S., "F-M Noise and Interference" published in 1941, electronics vol. 14 No. 8, Aug. 8, 1941, p. 37-42. Abstract Only.
Purnhagen, Heiko, "Low Complexity Parametric Stereo Coding in MPEG-4", Proc. Digital Audio Effects Workshop (DAFx) pp. 163-168, Naples, IT, Oct. 2004.
Baumgarte, F., et al., "Binaural Cue Coding—Part I:Pscyhoacoustic Fundamentals and Design Principles", IEEE Transactions on Speech and Audio Processing, vol. 11, No. 6, pp. 509-519, Nov. 2003.
Faller, C., et al., "Binaural Cue Coding—Part II:Schemes and Applications" IEEE Transactions on Speech and Audio Processing, vol. 11, No. 6, pp. 520-531, Nov. 2003.
Schuijers, E., et al., "Low Complexity Parametric Stereo Coding" AES Convention 116, May 2004.
Frenzel, L.E., "High-Definition Radio: It's the New Wave", Electronic Design, 2006, vol. 54, No. 7, pp. 40-48, Abstract Only.
PCT International Search Report of International Application PCT/EP2010/005481 filed on Sep. 7, 2010, in the name of Dolby International AB.
PCT Written Opinion of International Application PCT/EP2010/005481 filed on Sep. 7, 2010, in the name of Dolby International AB.
PCT International Preliminary Report on Patentability of International Application PCT/EP2010/005481 filed on Sep. 7, 2010, in the name of Dolby International AB.
PCT Supplemental Written Opinion (Rule 66 Communication) of International Application PCT/EP2010/005481 filed on Sep. 7, 2010, in the name of Dolby International AB.
Non-Final Office Action for U.S. Appl. No. 13/394,799, filed Apr. 24, 2012 on behalf of Jonas Engdegard. dated Aug. 29, 2013.
Final Office Action for U.S. Appl. No. 13/394,799, filed Apr. 24, 2012 on behalf of Jonas Engdegard. dated Jan. 29, 2014.
Advisory Action for U.S. Appl. No. 13/394,799, filed Apr. 24, 2012 on behalf of Jonas Engdegard. dated May 20, 2014.
Notice of Allowance for U.S. Appl. No. 13/394,799, filed Apr. 24, 2012 on behalf of Jonas Engdegard. dated Aug. 29, 2014.

AUDIO SIGNAL OF AN FM STEREO RADIO RECEIVER BY USING PARAMETRIC STEREO

CROSS REFERENCE TO RELATED APPLICATIONS

This application is a continuation of U.S. patent application Ser. No. 13/394,799, filed on Mar. 7, 2012, which is the national stage entry of PCT Application PCT/EP2010/005481, filed on Sep. 7, 2010, which claims priority to U.S. Provisional Patent Application No. 61/241,113 filed on Sep. 10, 2009, all of which are incorporated herein by reference in their entirety.

TECHNICAL FIELD

The present document relates to audio signal processing, in particular to an apparatus and a corresponding method for improving an audio signal of an FM stereo radio receiver.

BACKGROUND

In an analog FM (frequency modulation) stereo radio system, the left channel (L) and right channel (R) of the audio signal are conveyed in a midside (M/S) representation, i.e. as mid channel (M) and side channel (S). The mid channel M corresponds to a sum signal of L and R, e.g. M=(L+R)/2, and the side channel S corresponds to a difference signal of L and R, e.g. S=(L−R)/2. For transmission, the side channel S is modulated onto a 38 kHz suppressed carrier and added to the baseband mid signal M to form a backwards-compatible stereo multiplex signal. This multiplex signal is then used to modulate the HF (high frequency) carrier of the FM transmitter, typically operating in the range between 87.5 to 108 MHz.

When reception quality decreases (i.e. the signal-to-noise ratio over the radio channel decreases), the S channel typically suffers more than the M channel. In many FM receiver implementations, the S channel is muted when the reception conditions gets too noisy. This means that the receiver falls back from stereo to mono in case of a poor HF radio signal.

Parametric Stereo (PS) coding is a technique from the field of very low bitrate audio coding. PS allows encoding a 2-channel stereo audio signal as a mono downmix signal in combination with additional PS side information, i.e. the PS parameters. The mono downmix signal is obtained as a combination of both channels of the stereo signal. The PS parameters enable the PS decoder to reconstruct a stereo signal from the mono downmix signal and the PS side information. Typically, the PS parameters are time- and frequency-variant, and the PS processing in the PS decoder is typically carried out in a hybrid filterbank domain incorporating a QMF bank. The document "Low Complexity Parametric Stereo Coding in MPEG-4", Heiko Purnhagen, Proc. Digital Audio Effects Workshop (DAFx), pp. 163-168, Naples, IT, October 2004 describes an exemplary PS coding system for MPEG-4. Its discussion of parametric stereo is hereby incorporated by reference. Parametric stereo is supported e.g. by MPEG-4 Audio. Parametric stereo is discussed in section 8.6.4 and Annexes 8.A and 8.C of the MPEG-4 standardization document ISO/IEC 14496-3:2005 (MPEG-4 Audio, 3$^{rd}$ edition). These parts of the standardization document are hereby incorporated by reference for all purposes. Parametric stereo is also used in the MPEG Surround standard (see document ISO/IEC 23003-1:2007, MPEG Surround). Also, this document is hereby incorporated by reference for all purposes. Further examples of parametric stereo coding systems are discussed in the document "Binaural Cue Coding—Part I: Psychoacoustic Fundamentals and Design Principles," Frank Baumgarte and Christof Faller, IEEE Transactions on Speech and Audio Processing, vol 11, no 6, pages 509-519, November 2003, and in the document "Binaural Cue Coding—Part II: Schemes and Applications," Christof Faller and Frank Baumgarte, IEEE Transactions on Speech and Audio Processing, vol 11, no 6, pages 520-531, November 2003. In the latter two documents the term "binaural cue coding" is used, which is an example of parametric stereo coding.

Even in case the mid signal M is of acceptable quality, the side signal S may be noisy and thus can severely degrade the overall audio quality when being mixed in the left and right channels of the output signal (which are derived e.g. according to L=M+S and R=M-S). When a side signal S has only poor to intermediate quality, there are two options: either the receiver chooses accepting the noise associated with the side signal S and outputs real stereo, or the receiver drops the side signal S and falls back to mono.

SUMMARY OF THE INVENTION

A first aspect of the invention relates to an apparatus for improving an audio signal of an FM stereo radio receiver. The apparatus generates a stereo audio signal. The audio signal to be improved may be an audio signal in L/R representation, i.e. an L/R audio signal, or in an alternative embodiment an audio signal in M/S representation, i.e. an M/S audio signal. Typically, the audio signal to be improved is an audio signal in L/R representation since conventional FM radio receivers use an L/R output.

As an exemplary embodiment of the present invention, the apparatus is for an FM stereo radio receiver configured to receive an FM radio signal comprising a mid signal and side signal.

The apparatus comprises a parametric stereo (PS) parameter estimation stage. The parameter estimation stage is configured to determine one or more PS parameters based on the L/R or M/S audio signal in a frequency-variant or frequency-invariant manner. The one or more parameters may include a parameter indicating inter-channel intensity differences (HD or also called CLD—channel level differences) and/or a parameter indicating an inter-channel cross-correlation (ICC). Preferably, these PS parameters are time- and frequency-variant.

Moreover, the apparatus comprises an upmix stage. The upmix stage is configured to generate the stereo signal based on a first audio signal and the one or more PS parameters.

The first audio signal is obtained from the L/R or M/S audio signal, e.g. by a downmix operation in a downmix stage. The first audio signal may be obtained from the audio signal in case of an L/R representation by a downmix operation according to the following formula: DM=(L+R)/a, with DM corresponding to the first audio signal. For example, the parameter a is selected to be 2. In case of DM=(L+R)/a, the first audio signal essentially corresponds to the received mid signal M. In more advanced adaptive downmix schemes, the two parameters $a_1$, $a_2$ for combining the two channels according to the formula $DM=L/a_1+R/a_2$ may be different and/or may depend on the PS parameters and/or other signal properties.

In case of an M/S representation at the output of the FM stereo radio receiver, the first audio signal may simply correspond to the M signal of the M/S audio signal at the output.

The PS parameter estimation stage can be part of a PS encoder. The upmix stage can be part of a PS decoder.

The apparatus is based on the idea that due to its noise the received side signal may be not good enough for reconstructing the stereo signal by simply combining the received mid and side signals; nevertheless, in this case the side signal or the side signal's component in the L/R signal may be still good enough for stereo parameter analysis in the PS parameter estimation stage. These PS parameters may be then used for reconstructing the stereo signal.

Thus, the apparatus enables improved stereo reception under conditions of intermediate or even large noise in the side signal. It should be noted that the term "noise" is usually used in this specification to refer to the noise introduced from the limitations of the radio transmission channel (as opposed to the noise-like signal component originating in the actual audio signal being broadcast).

Instead of using a received noisy side signal to create the stereo audio signal, an improved side signal generated at receiver may be used. The improved side signal may be generated with help of techniques from PS coding. These include e.g. the generation of components of the improved side signal by means of a decorrelator operating on the first audio signal as input. Data about reception conditions and/or an analysis of the received stereo signal can be used to adaptively control the generation of the improved side signal and also the generation of the audio output signals.

According to another embodiment, the apparatus further comprises a decorrelator configured to generate a decorrelated signal based on the first audio signal. The upmix stage may generate the stereo signal based on the first audio signal, the one or more PS parameters and the decorrelated signal or at least frequency band of the decorrelated signal.

Instead of using the decorrelated signal, the upmix stage may use the received side signal for the upmix, e.g. in case of good reception conditions when the noise of the received side signal is low. Therefore, according to an embodiment, for the upmix selectively the received side signal or the decorrelated signal is used. More preferably, the selection is frequency-variant. For example, the upmix stage may use the received side signal for lower frequencies and may use the decorrelated signal as a pseudo side signal for higher frequencies since the higher the frequency, the larger is the noise density. This is a typical property of the FM demodulation in case of additive (white) noise on the radio channel. This will be explained in detail later in the specification.

The received side signal or at least one or more frequency components thereof may be used for upmix if the first signal corresponds to the mid signal. In case of a different downmix scheme (which is different from (L+R)/a for generating the first audio signal), a residual signal may be used for upmix instead of using the received side signal. Such a residual signal indicates the error associated with representing original channels by their downmix and PS parameters and is often used in PS encoding schemes. The above remarks to the use of the received side signal also apply to a residual signal.

The selection between the received side signal and the decorrelated signal for upmix may be signal-dependent or in other words signal-adaptive.

According to yet another embodiment, the selection depends on the reception conditions indicated by a radio reception indicator, such as the signal strength and/or on an indicator indicative of the quality of the received side signal. In case of good reception conditions (i.e. high strength), the received side signal can be preferably used for upmix (in some cases, not for the highest frequencies), whereas in case of intermediate reception conditions (i.e. lower strength), the decorrelated signal can be used for upmix.

In very bad reception conditions with high levels of noise on the side signal, the FM receiver may switch to a mono output mode to decrease the noise of the audio signal. In case of an L/R stereo audio signal at the output of the FM receiver, both channels at the output have the same signal in mono playback. In case of an M/S stereo signal at the output of the FM receiver, the S channel at the output is muted. In the mono output mode the stereo information is missing in the audio signal of the FM receiver. Thus, the PS parameter estimation stage cannot determine PS parameters suitable for creating a real stereo signal in the upmix stage. Even if the FM receiver does not switch to mono output mode in very bad reception conditions, the audio signal at the output of the FM receiver may be too bad for estimation of meaningful PS parameters.

The apparatus can be configured to detect whether the FM receiver has selected mono output of the stereo radio signal and/or can be configured to notice such poor reception conditions (which are too poor for estimation of meaningful PS parameters). In case of detecting mono output or in case of detecting such poor reception conditions, the upmix stage may generate a pseudo stereo signal. The upmix stage use one or more upmix parameters for blind upmix instead of the estimated parameters as discussed above. This mode is referred to as pseudo stereo operation or blind upmix operation.

Blind upmix operation specifies, in this case, that after detecting poor reception conditions or detecting mono output and thus initiating the blind upmix operation, spatial acoustic information—if at all present—in the output signal of the FM receiver is not used for determining the upmix parameters and thus is not considered for the upmix (if there is already a mono output at the output of the FM receiver no spatial acoustic information is present and thus cannot be considered at all). In contrast to the PS operation mode discussed above where the PS parameters are determined for reconstructing the side signal in the output signal of the upmix stage, in blind upmix operation the apparatus does not aim for reconstructing the side signal at the output signal of the upmix stage.

However, blind upmix does not mean that the apparatus is "blind" in that the upmix parameters are necessarily independent of the output signal of the FM receiver. E.g. the output signal of the FM receiver may be monitored whether it is music or speech, and dependent thereon appropriate upmix parameters may be selected.

One embodiment for blind upmix is to use preset upmix parameters. The preset upmix parameters may be default or stored upmix parameters.

Nevertheless, the used upmix parameters may be signal dependent, e.g. upmix parameters for speech and upmix parameters for music. In this case, the apparatus further has a speech detector (e.g. a speech/music discriminator) which detects whether the audio signal is predominantly speech or music. For example, in case of pure music the upmix parameters may be selected such that the downmix signal and the decorrelated version thereof are mixed, whereas in case of pure speech the upmix parameters may be selected such that the decorrelated version of the downmix signal is not used and only the downmix signal is used for upmix to a "mono" left/right signal. In case of an audio signal being a mixture of speech and music, blind upmix parameters may be used which are in between the upmix parameters for pure speech and the upmix parameters for pure music. One can further use interpolated upmix parameters for all states in between.

Advanced blind upmix schemes to pseudo stereo can be envisioned, where an even more advanced analysis of the mono signal is performed and this is used as the basis to derive "artificially generated" or "synthetic" PS parameters.

For a side signal with practically only noise, the apparatus preferably switches to pseudo stereo mode as discussed above. As noted above, the term "noise" here refers to the noise introduced by the bad radio reception (i.e. low signal-to-noise ratio on the radio channel), not to noise contained in the original signal sent to the FM broadcast transmitter.

However, for a side signal with almost no noise, i.e. almost no noise originating from the FM radio transmission, the apparatus preferably switches to normal stereo mode instead of parametric stereo mode. In normal stereo mode, the apparatus' signal improvement functionality is essentially deactivated. For deactivation, the left/right audio signal at the input of apparatus may be essentially fedthrough to the output of the apparatus.

Alternatively, for deactivation only the received side signal (and not the decorrelated signal) is mixed with the first audio signal in the upmix stage. When appropriately selecting the upmix parameters in the upmix stage, the output signal of the upmix stage corresponds to the output signal of the FM transmitter: e.g. when mixing of the first audio signal DM and the received side signal $S_0$ according to $$L'=DM+S_0 \text{ and } R'=DM-S_0, \text{ in case } DM=(L+R)/2 \text{ and } S_0=(L-R)/2.$$

More preferably in some instances, the normal stereo mode or the parametric stereo mode may be selected in a frequency-variant manner, i.e. the selection may be different for the different frequency bands. This is useful since the signal-to-noise ratio for the received side signal characteristically gets worse for higher frequencies. As discussed above, this is a typical property of the FM demodulation.

Further embodiments of the apparatus are discussed in the dependent claims.

A second aspect of the invention relates to an apparatus for generating a stereo signal based on left/right or mid/side audio signal of an FM stereo radio receiver. The apparatus is configured for noticing that the FM stereo receiver has selected mono output of the stereo radio signal or the apparatus is configured for noticing poor radio reception. The apparatus comprises a stereo upmix stage. The upmix stage is configured to generate the stereo signal based on a first audio signal and one or more upmix parameters for blind upmix in case the apparatus notices that the FM stereo receiver has selected mono output of the stereo radio signal or the apparatus notices poor reception. The first audio signal is obtained from the left/right or mid/side audio signal.

The upmix parameters for blind upmix may be preset parameters, such as default or stored parameters.

The apparatus allows generation of a pseudo stereo signal having a low level noise in case of very bad reception conditions with high levels of noise on the side signal. In such reception conditions, the FM receiver may switch to mono mode to decrease the noise of the audio signal or the L/R or M/S audio signal may be too bad for estimation of meaningful PS parameters. This is detected and then upmix parameters blind upmix are used for generating a pseudo stereo signal. This was already discussed in connection with the first aspect of the invention.

As also discussed in connection with the first aspect of the invention, the apparatus may comprise a detection stage for detecting whether the FM stereo receiver has selected mono output of the stereo radio signal.

According to an exemplary embodiment, the apparatus further comprises an audio type detector, such as a speech detector indicating whether the audio signal at the output of the FM transmitter is predominantly speech or not. In this case, the upmix parameters are dependent on the indication of the speech detector. E.g. the apparatus uses upmix parameters in case of speech and different upmix parameters in case of music as discussed in detail in connection with the first aspect of the invention.

The apparatus according to the second aspect of the invention may further include the features of the apparatus according to the first aspect of the invention and vice versa.

A third aspect of the invention relates to an FM stereo radio receiver configured to receive an FM radio signal comprising a mid signal and a side signal. The FM stereo radio receiver includes an apparatus for improving the audio signal according to the first and second aspects of the invention.

A fourth aspect of the invention relates to a mobile communication device, such as a cellular telephone. The mobile communication device comprises an FM stereo receiver configured to receive an FM radio signal. Moreover, the mobile communication device comprises an apparatus for improving the audio signal according to the first and second aspects of the invention.

A fifth aspect of the invention relates a method for improving a left/right or mid/side audio signal of an FM stereo radio receiver. The features of the method according to the fifth aspect correspond to the features of the apparatus according to the first aspect. One or more PS parameters are determined based on the left/right or mid/side audio signal in a frequency-variant or frequency-invariant manner. The stereo signal is generated based on said first audio signal and the one or more PS parameters by an upmix operation.

The remarks to the first aspect of the invention also apply to the fifth aspect of the invention.

A sixth aspect of the invention relates to a method for generating a stereo signal based on left/right or mid/side audio signal of an FM stereo radio receiver. The features of the method according to the sixth aspect correspond to the features of the apparatus according to the second aspect. It is noticed that the FM stereo receiver has selected mono output of the stereo radio signal or in an alternative embodiment poor radio reception is noticed. In case the FM stereo receiver has selected mono output of the stereo radio signal or in case of poor radio reception, the stereo signal is generated based on a first audio signal and one or more upmix parameters for blind upmix, such as preset upmix parameters.

The remarks to the second aspect of the invention also apply to the sixth aspect of the invention.

DESCRIPTION OF DRAWINGS

The invention is explained below by way of illustrative examples with reference to the accompanying drawings, wherein.

DETAILED DESCRIPTION

Figure 1:
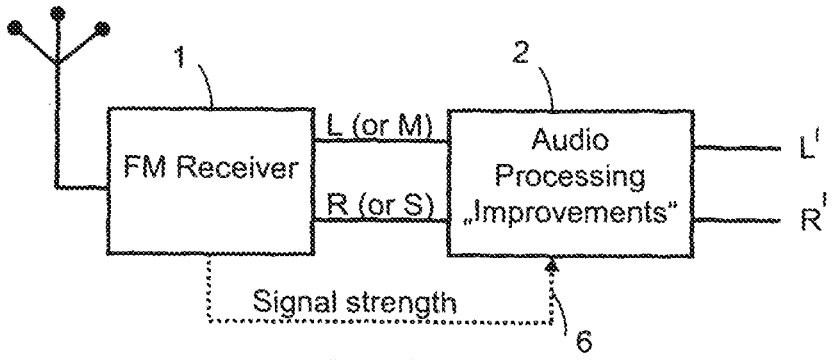
FIG. 1 illustrates a schematic embodiment for improving the stereo output of an FM stereo radio receiver.

FIG. 1 shows a simplified schematic embodiment for improving the stereo output of an FM stereo radio receiver 1. As discussed in the background section, in FM radio the stereo signal is transmitted by design as a mid signal and side signal. In the FM receiver 1, the side signal is used to create the stereo difference between the left channel L and the right channel R at the output of the FM receiver 1 (at least when reception is good enough and the side signal information is not muted). The left and right channels L, R may be digital or analog signals. For improving the audio signals L, R of the FM receiver, an audio processing apparatus 2 is used, which generates a stereo audio signal L' and R' at its output. The audio processing apparatus 2 corresponds to a system which is enabled to perform noise reduction of a received FM radio signal using parametric stereo. The audio processing in the apparatus 2 is preferably performed in the digital domain; thus, in case of an analog interface between the FM receiver 1 and the audio processing apparatus 2, an analog-to-digital converter is used before digital audio processing in the apparatus 2. The FM receiver 1 and the audio processing apparatus 2 may be integrated on the same semiconductor chip or may be part of two semiconductor chips. The FM receiver 1 and the audio processing apparatus 2 can be part of a wireless communication device such as a cellular telephone, a personal digital assistant (PDA) or a smart phone. In this case, the FM receiver 1 may be part of the baseband chip having additional FM radio receiver functionality.

Instead of using a left/right representation at the output of the FM receiver 1 and the input of the apparatus 2, a mid/side representation may be used at the interface between the FM receiver 1 and the apparatus 2 (see M, S in FIG. 1 for the mid/side representation and L, R for the left/right representation). Such a mid/side representation at the interface between the FM receiver 1 and the apparatus 2 may result in less effort since the FM receiver 1 already receives a mid/side signal and the audio processing apparatus 2 may directly process the mid/side signal without downmixing. The mid/side representation may be advantageous if the FM receiver 1 is tightly integrated with the audio processing apparatus 2, in particular if the FM receiver 1 and the audio processing apparatus 2 are integrated on the same semiconductor chip.

Optionally, a signal strength signal 6 indicating the radio reception condition may be used for adapting the audio processing in the audio processing apparatus 2. This will be explained later in this specification.

The combination of the FM radio receiver 1 and the audio processing apparatus 2 corresponds to an FM radio receiver having an integrated noise reduction system.

Figure 2:
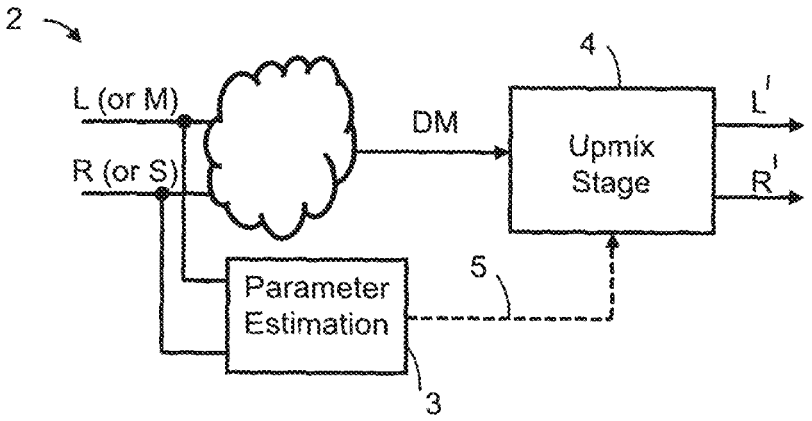
FIG. 2 illustrates an embodiment of the audio processing apparatus based on the concept of parametric stereo.

FIG. 2 shows an embodiment of the audio processing apparatus 2 which is based on the concept of parametric stereo. The apparatus 2 comprises a PS parameter estimation stage 3. The parameter estimation stage 3 is configured to determine PS parameters 5 based on the input audio signal to be improved (which may be either in left/right or mid/side representation). The PS parameters 5 may include, amongst others, a parameter indicating inter-channel intensity differences (IID or also called CLD—channel level differences) and/or a parameter indicating an inter-channel cross-correlation (ICC). Preferably, the PS parameters 5 are time- and frequency-variant. In case of an M/S representation at the input of the parameter estimation stage 3, the parameter estimation stage 3 may nevertheless determine PS parameters 5 which relate to the L/R channels.

An audio signal DM is obtained from the input signal. In case the input audio signal uses already a mid/side representation, the audio signal DM may directly correspond to the mid signal. In case the input audio signal has a left/right representation, the audio signal is generated by downmixing the audio signal. Preferably, the resulting signal DM after downmix corresponds to the mid signal M and may be generated by the following equation:

$$DM=(L+R)/a, \text{ e.g. with } a=2,$$

i.e. the downmix signal DM may correspond to the average of the L and R signals. For different values of a, the average of the L and R signals is amplified or attenuated.

The apparatus further comprises an upmix stage 4 also called stereo mixing module or stereo upmixer. The upmix stage 4 is configured to generate a stereo signal L', R' based on the audio signal DM and the PS parameters 5. Preferably, the upmix stage 4 does not only use the DM signal but also uses a side signal or some kind of pseudo side signal (not shown). This will be explained later in the specification in connection with more extended embodiments in FIGS. 4 and 5.

The apparatus 2 is based on the idea that due to its noise the received side signal may too noisy for reconstructing the stereo signal by simply combining the received mid and side signals; nevertheless, in this case the side signal or side signal's component in the L/R signal may be still good enough for stereo parameter analysis in the PS parameter estimation stage 3. The resulting PS parameters 5 can be then used for generating a stereo signal L', R' having a reduced level of noise in comparison to the audio signal directly at the output of the FM receiver 1.

Thus, a bad FM radio signal can be "cleaned-up" by using the parametric stereo concept. The major part of the distortion and noise in an FM radio signal is located in the side channel which may be not used in the PS downmix. Nevertheless, the side channel is even in case of bad reception often of sufficient quality for PS parameter extraction.

In all the following drawings, the input signal to the audio processing apparatus 2 is a left/right stereo signal. With minor modifications to some modules within the audio processing apparatus 2, the audio processing apparatus 2 can also process an input signal in mid/side representation. Therefore, the concepts discussed herein can be used in connection with an input signal in mid/side representation.

Figure 3:
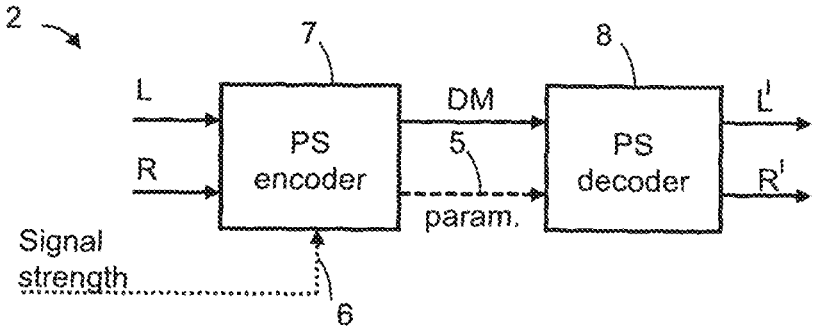
FIG. 3 illustrates another embodiment of the PS based audio processing apparatus having a PS encoder and a PS decoder.

FIG. 3 shows an embodiment of the PS based audio processing apparatus 2, which makes use of a PS encoder 7 and a PS decoder 8. The parameter estimation stage 3, in this example, is part of the PS encoder 7 and the upmix stage 4 is part of the PS decoder 8. The terms "PS encoder" and "PS decoder" are used as names for describing the function of the audio processing blocks within the apparatus 2. It should be noted that the audio processing is all Napping at the same FM receiver device. These PS encoding and PS decoding processes may be tightly coupled and the terms "PS encoding" and "PS decoding" are only used to describe the heritage of the audio processing functions.

The PS encoder 7 generates—based on the stereo audio input signal L, R—the audio signal DM and the PS parameters 5. Optionally, the PS encoder 7 further uses a signal strength signal 6. The audio signal DM is a mono downmix and preferably corresponds to the received mid signal. When summing the L/R channels to form the DM signal, the information of the received side channel may be completely excluded in the DM signal. Thus, in this case only the mid information is contained in the mono downmix DM. Hence, any noise from the side channel may be excluded in the DM signal. However, the side channel is part of the stereo parameter analysis in the encoder 7 as the encoder 7 typically takes L=M+S and R=M−S as input (consequently, DM=(L+R)/2=M).

Experimental results indicate that a received side signal that contains intermediate levels of noise may not be good enough for reconstructing stereo itself but can be good enough for stereo parameter analysis in a PS encoder 7.

The mono signal DM and the PS parameters 5 are used subsequently in the PS decoder 8 to reconstruct the stereo signal L', R'.

Figure 4:
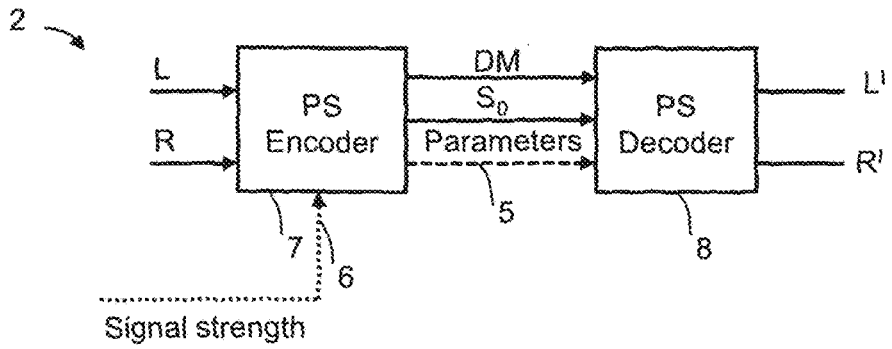
FIG. 4 illustrates an extended version of the audio processing apparatus of FIG. 3.

FIG. 4 shows an extended version of the audio processing apparatus 2 of FIG. 3. Here, in addition to the mono downmix signal DM and the PS parameters also the originally received side signal $S_0$ is passed on to the PS decoder 8. This approach is similar to "residual coding" techniques from PS coding, and allows to make use of at least parts (e.g. certain frequency bands) of the received side signal $S_0$ in case of good but not perfect reception conditions. The received side signal $S_0$ is preferably used in case the mono downmix signal corresponds to the mid signal. However, in case the mono downmix signal does not correspond to the mid signal, a more generic residual signal can be used instead of the received side signal $S_0$. Such a residual signal indicates the error associated with representing original channels by their downmix and PS parameters and is often used in PS encoding schemes. In the following, the remarks to the use of the received side signal $S_0$ apply also to a residual signal.

The use of a residual signal in an PS encoder/decoder is e.g. described in the MPEG Surround standard (see document ISO/IEC 23003-1:2007, MPEG Surround) and in the paper "MPEG Surround—The ISO/MPEG Standard for Efficient and Compatible Multi-Channel Audio Coding", J. Herre et al., Audio Engineering Convention Paper 7084, 122$^{nd}$ Convention, May 5-8, 2007.

Figure 5:
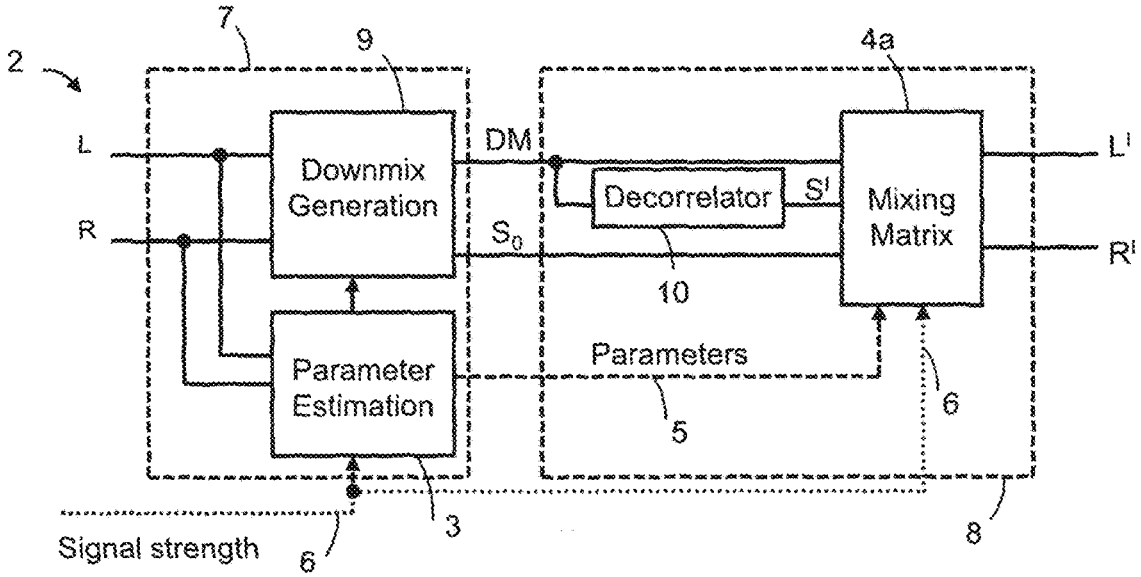
FIG. 5 illustrates an embodiment of the PS encoder and the PS decoder of FIG. 4.

FIG. 5 shows an embodiment of the PS encoder 7 and the PS decoder 8 of FIG. 4. The PS encoder module 7 comprises a downmix generator 9 and a PS parameter estimation stage 3. E.g. the downmix generator 9 may create a mono downmix DM which preferably corresponds to a mid signal M (e.g. DM=M=(L+R)/a) and may optionally also generate a second signal which corresponds to the received side signal $S_0$=(L−R)/a.

The PS parameter estimation stage 3 may estimate as PS parameters 5 the correlation and the level difference between the L and R inputs. Optionally, the parameter estimation stage receives the signal strength 6 which may be the signal power at the FM receiver. This information can be used to decide about the reliability, e.g. in case of a low signal strength 6, of the PS parameters 5. In case of a low reliability the PS parameters 5 may be set such that the output signal L', R' is a mono output signal or a pseudo stereo output signal. In case of a mono output signal, the output signal L' is equal to the output signal R'. In case of a pseudo stereo output signal, default PS parameters may be used to generate a pseudo or default stereo output signal L', R'.

The PS decoder module 8 comprises a stereo mixing matrix **4*a* and a decorrelator 10. The decorrelator receives the mono downmix DM and generates a decorrelated signal S' which is used as a pseudo side signal. The decorrelator 10 may be realized by an appropriate all-pass filter as discussed in section 4 of the cited document "Low Complexity Parametric Stereo Coding in MPEG-4". The stereo mixing matrix 4*a*** is a 2×2 upmix matrix in this embodiment.

Dependent upon the estimated parameters 5, the matrix **4*a* mixes the DM signal with the received side signal $S_0$ or the decorrelated signal S' to create the stereo output signals L' and R'. The selection between the signal $S_0$ and the signal S' may depend on a radio reception indicator indicative of the reception conditions, such as the signal strength 6**. One may instead or in addition use a quality indicator indicative of the quality of the received side signal. One example of such a quality indicator may be an estimated noise (power) of the received side signal. In case of a side signal comprising a high degree of noise, the decorrelated signal S' may be used to create the stereo output signal L' and R', whereas in low noise situations, the side signal $S_0$ may be used. Various embodiments for estimating the noise of the received side signal are discussed later in this specification.

As an example, in case of good reception conditions (i.e. the signal strength is high), the signal $S_0$ is used for upmixing, whereas in case of bad conditions the upmixing is based on the decorrelated signal S'. Preferably, the decision whether the stereo mixing module 4 uses the received side signal $S_0$ or S' is frequency dependent, e.g. for lower frequencies the received side signal $S_0$ is used and for higher frequencies the decorrelated signal S' is used. This will be discussed more in detail in connection with FIG. 6.

The frequency-variant or frequency-invariant selection between the signal $S_0$ and the signal S' may be done in the upmix stage 4 (e.g. by selector means in the upmix stage 6 which are controlled e.g. in dependency of the signal strength 6). Alternatively, the frequency-variant or frequency-invariant selection between the signal $S_0$ and the signal S' may be performed in the parameter estimation stage 3 (e.g. in dependency of the signal strength 6), and the parameter estimation stage 3 then sends upmix parameters to the upmix stage 6 that cause that the respectively selected signal (either $S_0$ or S') is used for the upmix, e.g. the upmix parameters relating to the signal $S_0$ are set to zero and the parameters relating to S' are not set to zero in case of selecting S'. Alternatively, a selection signal (not shown) may be send to the upmix stage 6.

The upmix operation is preferably carried out according to the following matrix equation:

$$\begin{pmatrix} L' \\ R' \end{pmatrix} = \begin{pmatrix} \alpha & \beta \\ \gamma & \delta \end{pmatrix} \begin{pmatrix} DM \\ S \end{pmatrix}$$

Here, the weighting factors α, β, γ, δ determine the weighting of the signals DM and S. The mono downmix DM preferably corresponds to the received mid signal. The signal S in the formula corresponds either to the decorrelated signal S' or to the received side signal $S_0$. The upmix matrix elements, i.e. the weighting factors α, β, γ, δ, may be derived e.g. as shown the cited paper "Low Complexity Parametric Stereo Coding in MPEG-4" (see section 2.2), as shown in the cited MPEG-4 standardization document ISO/IEC 14496-3:2005 (see section 8.6.4.6.2) or as shown in MPEG Surround specification document ISO/IEC 23003-1 (see section 6.5.3.2). These sections of the documents (and also sections referred to in these sections) are hereby incorporated by reference for all purposes.

Figure 6:
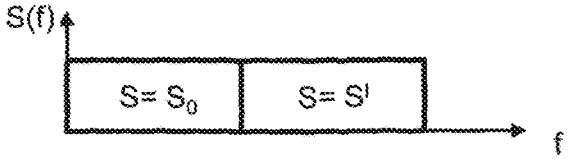
FIG. 6 illustrates an exemplary structure of the signal S used for upmix.

Preferably, the selection between S' and $S_0$ is frequency dependent. This is shown in FIG. 6 indicating an exemplary structure of the signal S used for upmix. As indicated in FIG. 6, for lower frequencies the received side signal $S_0$ is used for upmix and for higher frequencies the decorrelated signal S' is used for upmix.

If the received side signal $S_0$ corresponds to $S_0=(L-R)/2$ and $L'=M+S_0$ and $R'=M-S_0$, the mono downmix DM should preferably correspond to (L+R)/2; this allows perfect reconstruction, i.e. L'=L and R'=R.

Instead of using a PS upmixer using the received side signal $S_0$, a generalized PS upmixer using a residual signal may be used. The resulting signals L', R' are function of the PS parameters, the residual signal and the mono downmix.

Figure 7:
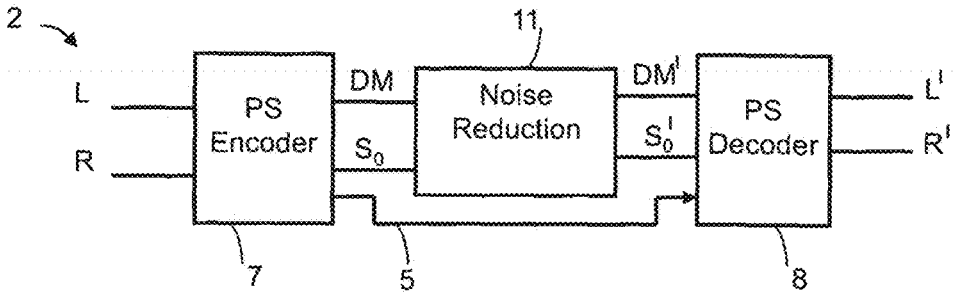
FIG. 7 illustrates an extended version of the audio processing apparatus of FIG. 3, where a noise reduction algorithm is added.

FIG. 7 shows an exemplary embodiment using noise reduction. As in FIG. 5, in FIG. 7 the signal $S_0$ is optional. In case of having a signal $S_0$, a common noise reduction algorithm may be used, which performs noise reduction of the DM and $S_0$ signals. Alternatively, two differently configured noise reduction modules may be used, one for noise reduction of the signal DM and one for noise reduction of the signal $S_0$. It is also possible that only one signal may be subject to noise reduction (e.g. the signal DM or the signal $S_0$). In FIG. 7, the noise reduction stage 11 performs noise reduction of the signal DM and the noise reduced signal DM' after noise reduction is fed to the PS decoder 8 and its internal upmix stage 4. The noise reduction stage 11 performs noise reduction of the signal $S_0$ and the noise reduced signal $S_0'$ after noise reduction is fed to the PS decoder 8.

Figure 8:
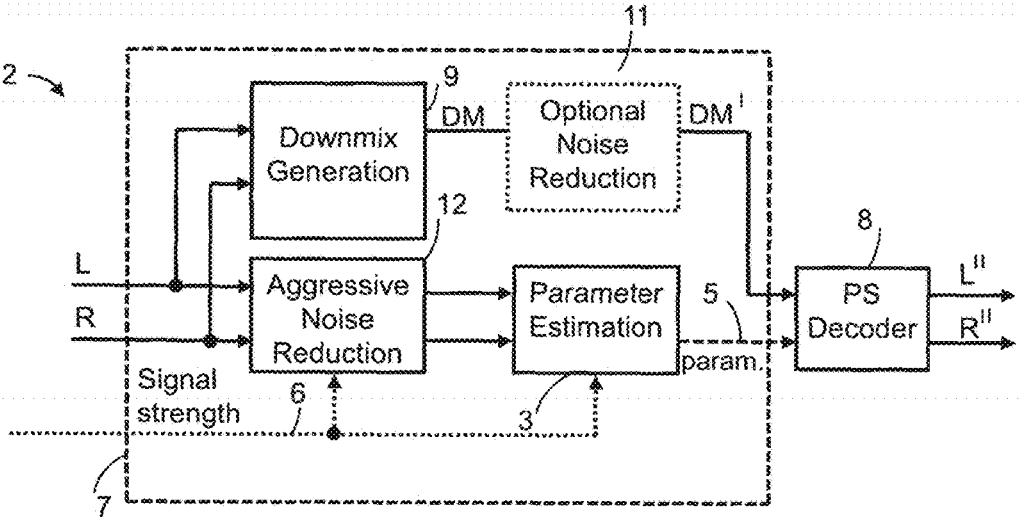
FIG. 8 illustrates a further embodiment of the audio processing apparatus with noise reduction for PS parameter estimation.

FIG. 8 shows a further embodiment of the apparatus 2. Here, a noise reduction method 12 is applied on the stereo input signal, the resulting noise reduced signal R', L' is thereafter analyzed by the PS parameter estimation stage 3 of the PS encoder 8. The noise reduction may be very aggressive and optimized for the PS parameter extraction as the downmix signal DM takes another path not including the noise reduction stage 12.

The mono downmix signal DM may be generated by adding the L, R channels with same weighting factors (e.g. using weighting factors of 1 or using weighting factors of ½). The signal DM then corresponds to the received mid signal. When using weighting factors of ½, the amplitude of the signal DM is half of the amplitude of the signal DM in case when using weighting factors of 1.

Optionally, some form of noise reduction may be also applied to the signal L/R or the signal DM (and/or the $S_0$ signal if used). E.g. some noise reduction may be applied to the signal DM (see the optional noise reduction stage 11 in FIG. 8). Preferably, this noise reduction stage is gentler than the aggressive noise reduction stage 12. The noise reduction stage 11 may be alternatively placed upstream of the downmix stage 9 (e.g. at the input of the apparatus 2 or directly before the downmix stage 9).

In certain reception conditions, the FM receiver 1 only provides a mono signal, with the conveyed side signal being muted. This will typically happen when the reception conditions are very bad and the side signal is very noisy. In case the FM stereo receiver 1 has switched to mono playback of the stereo radio signal, the upmix stage preferably uses upmix parameters for blind upmix, such as preset upmix parameters, and generates a pseudo stereo signal, i.e. the upmix stage generates a stereo signal using the upmix parameters for blind upmix.

There are also embodiments of the FM stereo receiver 1 which switch at too poor reception conditions to mono playback. If the reception conditions are too poor for estimation of reliable PS parameters 5, the upmix stage preferably uses upmix parameters for blind upmix and generates a pseudo stereo signal based thereon.

Figure 9:
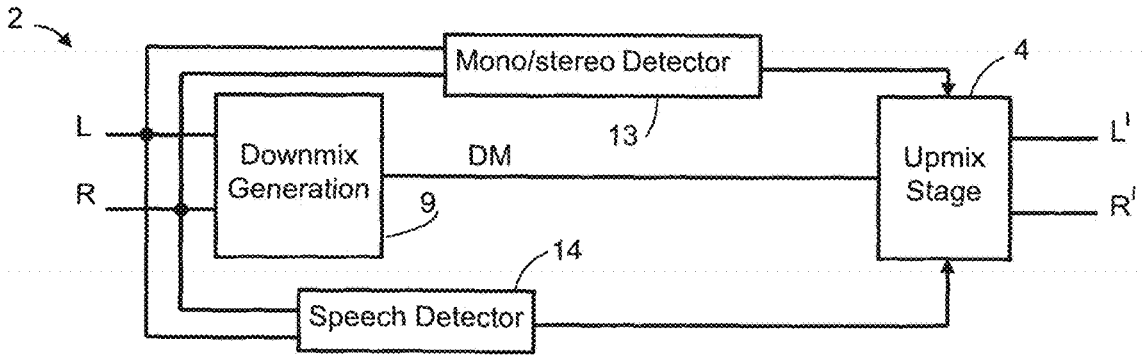
FIG. 9 illustrates another embodiment of the audio processing apparatus for pseudo-stereo generation in case of mono only output of the FM receiver.

FIG. 9 shows an embodiment for the pseudo-stereo generation in case of mono only output of the FM receiver 1. Here, a mono/stereo detector 13 is used to detect whether the input signal to the apparatus 2 is mono, i.e. whether the signals of the L and R channels are the same. In case of mono playback of the FM receiver 1, the mono/stereo detector 13 indicates to upmix to stereo using e.g. a PS decoder with fixed upmix parameters. In other words: in this case, the upmix stage 4 does not use PS parameters from the PS parameter estimation stage 3 (not shown in FIG. 9), but uses fixed upmix parameters (not shown in FIG. 9).

Optionally, a speech detector 14 may be added to indicate if the received signal is predominantly speech or music. Such speech detector 14 allows for signal dependent blind upmix. E.g. such a speech detector 14 may allow for signal dependent upmix parameters. Preferably, one or more upmix parameters may be used for speech and different one or more upmix parameters may be used for music. Such a speech detector 14 may be realized by a Voice Activity Detector (VAD). Strictly speaking, the upmix stage 4 in FIG. 9 comprises a decorrelator 10, a 2×2 upmix matrix 4*a*, and means to convert the output of the mono/stereo detector 13 and the speech detector 14 into some form of PS parameters used as input to the actual stereo upmix.

Figure 10:
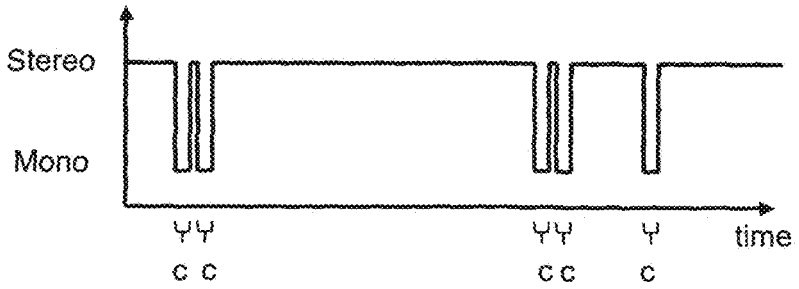
FIG. 10 illustrates the occurrence of short drop-outs in stereo playback at the output of the FM receiver.

FIG. 10 illustrates a common problem when the audio signal provided by the FM receiver 1 toggles between stereo and mono due to time-variant bad reception conditions (e.g. "fading"). To maintain a stereo sound image during mono/stereo toggling, error concealment techniques may be used. Time intervals where concealment shall be applied are indicated by "C" in FIG. 10. An approach to concealment in PS coding is to use upmix parameters which are based on the previously estimated PS parameters in case that new PS parameters cannot be computed because the audio output of the FM receiver 1 dropped down to mono. E.g. the upmix stage 4 may continue to use the previously estimated PS parameters in case that new PS parameters cannot be computed because the audio output of the FM receiver 1 dropped down to mono. Thus, when the FM stereo receiver 1 switches to mono audio output, the stereo upmix stage 4 continues to use the previously estimated PS parameters from the PS parameter estimation stage 3. If the dropout periods in the stereo output are short enough so that the stereo sound image of the FM radio signal remains similar during a dropout period, the dropout is not audible or only scarcely audible in the audio output of the apparatus 2.

Another approach may be to interpolate and/or extrapolate upmix parameters from previously estimated parameters. With respect to determination of upmix parameters based on the previously estimated PS parameters, one may, in light of the teachings herein also use other techniques known e.g. from error concealment mechanisms that can be used in audio decoders to mitigate the effect of transmission errors (e.g. corrupt or missing data).

The same approach of using upmix parameters based on the previously estimated PS parameters can be also applied if the FM receiver 1 provides a noisy stereo signal during a short period of time, with the noisy stereo signal being too bad to estimate reliable PS parameters based thereon.

In the following, an advanced PS parameter estimation stage 3' providing error compensation is discussed with reference to FIG. 11. In case of estimating PS parameters based on a stereo signal containing a noisy side component, there will be an error in the calculation of the PS parameters if conventional formulas for determining the PS parameters are used, such as for determining the CLD parameter (Channel Level Differences) and the ICC parameter (Inter-channel Cross-Correlation).

When assuming that the noise in the side signal is independent of the mid signal:

- the ICC values get closer to 0 in comparison to the ICC values estimated based on a noiseless stereo signal, and
- the CLD values in decibel get closer to 0 dB in comparison to the CLD values estimated based on a noiseless stereo signal.

For compensation of the error in the PS parameters the apparatus 2 preferably has a noise estimate stage which is configured to determine a noise parameter characteristic for the power of the noise of the received side signal that was caused by the (bad) radio transmission. The noise parameter is considered when estimating the PS parameters. This may be implemented as shown in FIG. 11.

Figure 11:
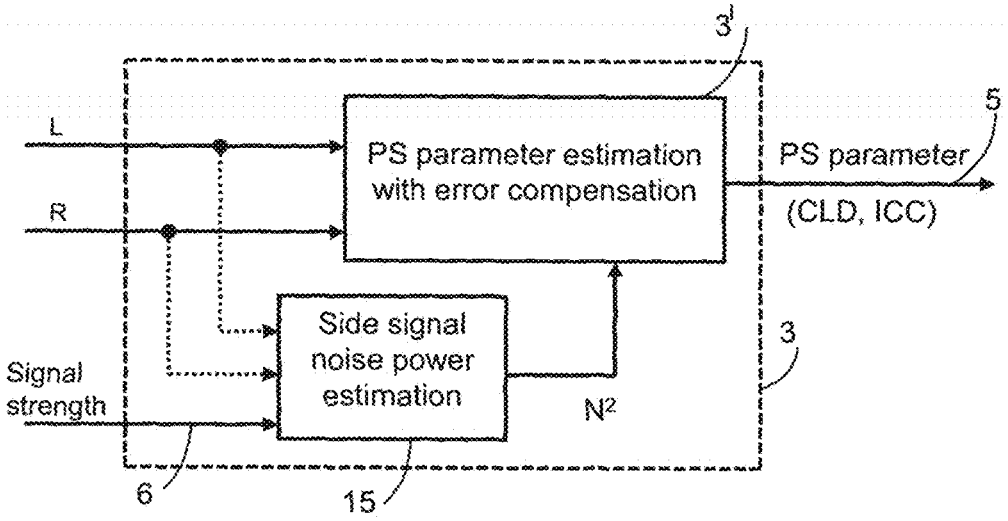
FIG. 11 illustrates an advanced PS parameter estimation stage with error compensation.

According to FIG. 11, the signal strength data 6 may be used for at least partly compensating the error. The signal strength 6 is often available in FM radio receivers. The signal strength 6 is input to the parameter analyzing stage 3 in the PS encoder 7. In a side signal noise power estimation stage 15, the signal strength value 6 may be converted to a side signal noise power estimate $N^2$, with $N^2=E(n^2)$, where "E( )" is the expectation operator. As an alternative to the signal strength 6 or in addition to the signal strength 6, the audio signal L, R may be used for estimating the signal noise power as will be discussed later on.

The actual noisy stereo input signal values $l_{w/noise}$ and $r_{w/noise}$, which are input to the inner PS parameter estimation stage 3' shown in FIG. 11, can be expressed in dependency of the respective values $l_{w/o\ noise}$ and $r_{w/o\ noise}$ without noise and the noise values n of the received side signal values:

$$l_w/\text{noise}=m+(s+n)=l_{w/o\ noise}+n$$

$$r_w/\text{noise}=m-(s+n)=r_{w/o\ noise}-n$$

It should be noted that here the received side signal is modeled as s+n, where "s" is the original (undistorted) side signal, and "n" is the noise (distortion signal) caused by the radio transmission channel. Furthermore, it is assumed here that the signal m is not distorted by noise from the radio transmission channel.

Thus, the corresponding input powers $L_{w/noise}^2$, $R_{w/noise}^2$ and the cross correlation $L_{w/noise}R_{w/noise}$ can be written as:

$$L_{w/noise}^2=E(l_{w/noise}^2)E((m+s)^2)+E(n^2)=L_{w/o\ noise}^2+N^2$$

$$R_{w/noise}^2=E(r_{w/noise}^2)=E((m-s)^2)+E(n^2)=R_{w/o\ noise}^2+N^2$$

$$L_{w/noise}R_{w/noise}=E(l_{w/noise}\cdot r_{w/noise})=E((l_{w/o\ noise}+n)\cdot(r_{w/o\ noise}-n))=L_{w/o\ noise}R_{w/o\ noise}-N^2$$

with the side signal noise power estimate $N^2$, with $N^2=E(n^2)$, where "E( )" is the expectation operator.

By rearranging the above equations, the corresponding compensated powers and cross-correlation without noise can be determined to be:

$$L_{w/o\ noise}^2=L_{w/noise}^2-N^2$$

$$R_{w/o\ noise}^2=R_{w/noise}^2-N^2$$

$$L_{w/o\ noise}R_{w/o\ noise}=L_{w/noise}R_{w/noise}+N^2$$

An error-compensated PS parameter extraction based on the compensated powers and cross correlation may be carried out as given by the formulas below:

$$\text{CLD}=10\cdot\log_{10}(L_{w/o\ noise}^2/R_{w/o\ noise}^2)$$

$$\text{ICC}=(L_{w/o\ noise}R_{w/o\ noise})/(L_{w/o\ noise}^2+R_{w/o\ noise}^2)$$

Such a parameter extraction compensates for the estimated $N^2$ term in the calculation of the PS parameters.

In FIG. 11, the side signal noise power estimation stage 15 is configured to derive the noise power estimate $N^2$ based on the signal strength 6 and/or the audio input signals (L and R). The noise power estimate $N^2$ can be both frequency-variant and time-variant.

A variety of methods can be used for determining the side signal noise power $N^2$, e.g.:

- When detecting power minima of the mid signal (e.g. pauses in speech), it can be assumed that the power of the side signal is noise only (i.e. the power of the side signal corresponds to $N^2$ in these situations).
- The $N^2$ estimate can be defined by a function of the signal strength data 6. The function (or lookup table) can be designed by experimental (physical) measurements.
- The $N^2$ estimate can be defined by a function of the signal strength data 6 and/or the audio input signals (L and R). The function can be designed by heuristic rules.
- The $N^2$ estimate can be based on studying the signal type coherence of the mid and side signals. The original mid and side signals can e.g. be assumed to have similar tonality-to-noise ratio or crest factor or other power envelope characteristics. Deviations of those properties can be used to indicate a high level of $N^2$.

In the following further preferred embodiments of the audio processing apparatus 2 are discussed.

Preferably, the apparatus 2 is configured in such a way that for received side signals with practically only noise, the apparatus 2 smoothly switches to pseudo stereo (blind upmix) operation, as illustrated in FIGS. 9 and 10. This allows to output a pseudo stereo signal at the output of the apparatus 2 in case the FM receiver 1 has switched to mono operation (due to the high level of noise caused by bad reception conditions) or in case the side signal portion in the stereo signal at the input of the apparatus 2 is so noisy that reliable PS parameters cannot be estimated.

For side signals with almost no noise, the apparatus 2 preferably switches smoothly to normal stereo operation instead of parametric stereo operation. In normal stereo operation, the signal improvement functionality of the apparatus 2 is essentially deactivated. For deactivation, the audio signal at the input of apparatus may be essentially fedthrough to the output of the apparatus 2.

Alternatively, the normal stereo operation may be accomplished by using the received side signal $S_0$, as illustrated in FIG. 4 and FIG. 6: For normal stereo operation, the received side signal $S_0$ is used for mixing in the upmix stage 4. When appropriately selecting the upmix parameters in the upmix stage 4, the output signal L', R' of the upmix stage 4 corresponds to the output signal L, R of the FM transmitter 1: e.g. when mixing the mono downmix DM and the received signal $S_0$ according to:

$$L'=DM+S_0,\ R'=DM-S_0,$$

in case DM=M=(L+R)/2 and $S_0$=(L−R)/2.

More preferably, the normal stereo mode or the parametric stereo mode may be selected in a frequency-variant manner, i.e. the selection may be different for the different frequency bands. This is useful since the signal-to-noise ratio for the received side signal gets worse for higher frequencies.

The smooth switching between different operation modes may be adapted dynamically to the current reception conditions, in order to provide always the best possible stereo signal at the output of the apparatus 2. In case of a high signal-to-noise ratio normal FM stereo operation (without noise reduction based on PS processing) is preferred, whereas in case of a low signal-to-noise ratio PS processing greatly improves the stereo signal.

Preferably, the generation of the mono downmix DM in the PS encoder 7 should be done such that as little as possible noise from the side signal leaks into the mono downmix DM. This can require different downmix techniques than those typically used in a PS encoder (such as an MPEG-4 PS encoder for MPEG-4) which is normally employed in the context of a very low bitrate coding system. This can be as simple as a fixed (non-adaptive) downmix DM=M=(L+R)/2, where the downmix simply correspond to the mid signal. Furthermore, the upmix in the PS decoder 8 is typically adapted to the actual downmix technique used in the PS encoder 7.

It should be noted that although in several drawings the PS encoder 7 and the PS decoder 8 are shown as separate modules, it is of course advantageous in the context of an efficient implementation to merge PS encoder 7 and the PS decoder 8 as much as possible.

The concepts discussed herein can be implemented in connection with any encoder using PS techniques, e.g. an HE-AAC v2 (High-Efficiency Advanced Audio Coding version 2) encoder as defined in the standard ISO/IEC 14496-3 (MPEG-4 Audio), an encoder based on MPEG Surround or an encoder based on MPEG USAC (Unified Speech and Audio coder) as well as encoders which are not covered by MPEG standards.

In the following, by way of example, a HE-AAC v2 encoder is assumed; nevertheless, the concepts may be used in connection with any audio encoder using PS techniques.

HE-AAC is a lossy audio compression scheme. HE-AAC v1 (HE-AAC version 1) makes use of spectral band replication (SBR) to increase the compression efficiency. HE-AAC v2 further includes parametric stereo to enhance the compression efficiency of stereo signals at very low bitrates. An HE-AAC v2 encoder inherently includes a PS encoder to allow operation at very low bitrates. The PS encoder of such an HE-AAC v2 encoder can be used as the PS encoder 7 of the audio processing apparatus 2. In particular, the PS parameter estimating stage within a PS encoder of an HE-AAC v2 encoder can be used as the PS parameter estimating stage 3 of the audio processing apparatus 2. Also the downmix stage within a PS encoder of an HE-AAC v2 encoder can be used as the downmix stage 9 of the apparatus 2.

Figure 12:
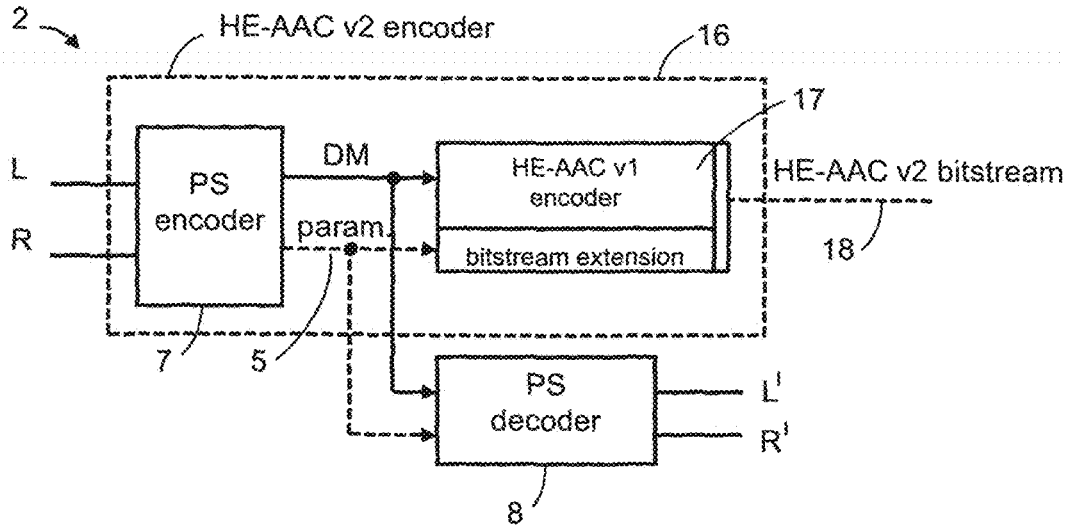
FIG. 12 illustrates a further embodiment of the audio processing apparatus based on an HE-AAC v2 encoder.

Hence, the concept discussed in this specification can be efficiently combined with an HE-AAC v2 encoder to realize an improved FM stereo radio receiver. Such an improved FM stereo radio receiver may have an HE-AAC v2 recording feature since the HE-AAC v2 encoder outputs an HE-AAC v2 bitstream which can stored for recording purposes. This is shown in FIG. 12. In this embodiment, the apparatus 2 comprises an HE-AAC v2 encoder 16 and the PS decoder 8. The HE-AAC v2 encoder provides the PS encoder 7 used for generating the mono downmix DM and the PS parameters 5 as discussed in connection with the previous drawings.

Optionally, the PS encoder 7 may be modified for the purpose of FM radio noise reduction to support a fixed downmix scheme, such as a downmix scheme according to DM=(L+R)/a.

The mono downmix DM and the PS parameters 8 may be fed to the PS decoder 8 to generate the stereo signal L', R' as discussed above. The mono downmix DM is fed to an HE-AAC v1 encoder for perceptual encoding of the mono downmix DM. The resulting perceptual encoded audio signal and the PS information are multiplexed into an HE-AAC v2 bitstream 18. For recording purposes, the HE-AAC v2 bitstream 18 can be stored in a memory such as a flash-memory or a hard-disk.

The HE-AAC v1 encoder 17 comprises an SBR encoder and an MC encoder (not shown). The SBR encoder typically performs signal processing in the QMF (quadrature mirror filterbank) domain and thus needs QMF samples. In contrast, the MC encoder typically needs time domain samples (typically downsampled by a factor 2).

The PS encoder 7 within the HE-MC v2 encoder 16 typically provides the downmix signal DM already in the QMF domain.

Since the PS encoder 7 may already send the QMF domain signal DM to the HE-AAC v1 encoder, the QMF analysis transform in the HE-AAC v1 encoder for the SBR analysis can be made obsolete. Thus, the QMF analysis that is normally part of the HE-MC v1 encoder can be avoided by providing the downmix signal DM as QMF samples. This reduces the computing effort and allows for complexity saving.

The time domain samples for the AAC encoder may be derived from the input of the apparatus 2, e.g. by performing the simple operation DM=(L+R)/2 in the time domain and by downsampling the time domain signal DM. This approach is probably the cheapest approach. Alternatively, the apparatus 2 may perform a half-rate QMF synthesis of the QMF domain DM samples.

It should be noted that the PS encoder and PS decoder can be partly merged if both are implemented in the same module.

What is claimed is:

1. A method for improving a left/right or mid/side audio signal output by a frequency modulation (FM) stereo radio receiver, the method comprising:

receiving the left/right or mid/side audio signal from the FM stereo radio receiver;

generating a first audio signal based on the left/right or mid/side audio signal by a downmix operation;

determining one or more parametric stereo parameters based on the left/right or mid/side audio signal in a frequency-variant;

receiving the first audio signal and outputting a decorrelated signal; and generating a stereo signal based on the first audio signal, the one or more parametric stereo parameters, and selectively on:

a second audio signal or at least a frequency band thereof, the second audio signal being a received side signal or a residual signal, the residual signal indicating an error associated with representing the left/right or mid/side audio signal by the first audio signal and the one or more parametric stereo parameters, or the decorrelated signal, wherein:

the generating the stereo signal selectively based on the second audio signal or the decorrelated signal is frequency-variant and uses:

the second audio signal for a first frequency range and the decorrelated signal for a second frequency range, the frequencies of the first frequency range being lower than the frequencies of the second frequency range.

2. The method of claim 1, wherein the method further comprises generating a decorrelated signal based on the first audio signal, and the generating the stereo signal is based on the first audio signal, the one or more parametric stereo parameters, and the decorrelated signal or at least a frequency band thereof.

3. The method of claim 1, wherein the generating the first audio signal is according to the following formula:

$$(L+R)/a$$

wherein L and R denote the left and right channels of a left/right audio signal and a is a real number.

4. The method of claim 1, wherein the first audio signal corresponds to a received mid signal.

5. The method of claim 1, further comprising deriving the second audio signal based on the left/right audio or mid/side audio signal.

6. The method of claim 1, wherein the generating the stereo signal selectively depends:

on a radio reception indicator indicative of the radio reception condition, and/or on a quality indicator indicative of the quality of the received side signal.

7. The method of claim 1, wherein the one or more parametric stereo parameters include a parameter indicating a channel level difference and/or a parameter indicating an inter-channel cross-correlation.

8. The method of claim 1, further comprising:

performing noise reduction of the first audio signal, and generating the stereo signal based on a noise reduced first audio signal and the one or more parametric stereo parameters.

9. The method of claim 1, further comprising:

performing noise reduction on the left/right or mid/side audio signal, and generating the one or more parametric stereo parameters based on the reduced left/right or mid/side audio signal.

10. The method of claim 9, further comprising:

obtaining the first audio signal from the noise reduced left/right or mid/side audio signal.

11. The method of claim 1, further comprising:

a noise parameter characteristic for the noise power of the received side signal; and determining the one or more parametric stereo parameters based on the left/right or mid/side audio signal and the noise parameter in a frequency-variant or frequency-invariant manner.

12. The method of claim 1, further comprising:

noticing that the FM stereo receiver selects mono output of the stereo radio signal or noticing poor radio reception; and using one or more upmix parameters for blind upmix in case that the FM stereo receiver selecting mono output of the stereo radio signal is noticed or poor reception is noticed.

13. The method of claim 12, wherein the one or more upmix parameters for blind upmix are one or more preset upmix parameters.

14. The method of claim 12, further comprising:

detecting whether the left/right or mid/side audio signal is predominantly speech, the one or more upmix parameters for blind upmix being dependent on said detection.

15. The method of claim 1, further comprising:

noticing that the FM stereo receiver selects mono output of the stereo radio signal or noticing poor radio reception; and when the FM stereo receiver switches to mono output or poor radio reception is noticed, the generating the stereo signal uses one or more upmix parameters which are based on one or more previously estimated parametric stereo parameters from the determining.

16. The method of claim 15, wherein the generating the stereo signal continues to use the one or more previously estimated parametric stereo parameters as upmix parameters when the FM stereo receiver switches to mono output or poor radio reception occurs.

17. The method of claim 1, further comprising selecting the normal stereo mode in a frequency-variant manner.

18. The method of claim 1, wherein the determining one or more parametric stereo parameters is carried out with error compensation.

* * * * *